US008696249B2

(12) United States Patent
Steyn

(10) Patent No.: US 8,696,249 B2
(45) Date of Patent: Apr. 15, 2014

(54) ROCK BOLT AND ROCK BOLT COMPONENT

(71) Applicant: Johann Steyn, Germiston (ZA)

(72) Inventor: Johann Steyn, Germiston (ZA)

(73) Assignee: RSC Mining (Pty) Ltd, Germiston (ZA)

( * ) Notice: Subject to any disclaimer, the term of this patent is extended or adjusted under 35 U.S.C. 154(b) by 0 days.

(21) Appl. No.: 13/706,705

(22) Filed: Dec. 6, 2012

(65) Prior Publication Data

US 2013/0149041 A1 Jun. 13, 2013

(30) Foreign Application Priority Data

Dec. 9, 2011 (ZA) ..... 2011/09056

(51) Int. Cl.
*E21D 21/00* (2006.01)

(52) U.S. Cl.
USPC ..... 405/259.1; 405/259.2; 405/259.3; 405/259.4; 411/388; 411/389; 411/121

(58) Field of Classification Search
CPC ..... E21D 21/0093
USPC ..... 405/259.1–259.4; 411/388, 389, 411/119–121, 176, 180
See application file for complete search history.

(56) References Cited

U.S. PATENT DOCUMENTS

| | | | | |
|---|---|---|---|---|
| 7,318,689 | B2 * | 1/2008 | Kanflod et al. | 405/259.5 |
| 2003/0219316 | A1 * | 11/2003 | Rataj | 405/259.1 |
| 2011/0103896 | A1 * | 5/2011 | Horsch et al. | 405/259.1 |

* cited by examiner

*Primary Examiner* — John Kreck
*Assistant Examiner* — Carib Oquendo
(74) *Attorney, Agent, or Firm* — Mattingly & Malur, PC

(57) ABSTRACT

A rock bolt component includes an elongate tubular section with an internal bore. A fixing member has an elongate body that includes a securing portion positionable in the internal bore of the tubular section and a coupling formation which projects from an opposite end of the fixing member. The fixing member is securable by deformation of an end of the tubular section, once the securing portion of the fixing member has been inserted into the end of the tubular section.

4 Claims, 2 Drawing Sheets

ROCK BOLT AND ROCK BOLT COMPONENT

CROSS-REFERENCE TO RELATED APPLICATIONS

This application corresponds to and claims priority from South African Patent Application No. 2011/09056, filed Dec. 9, 2011, the disclosure of which is expressly incorporated herein in its entirety.

FIELD OF THE INVENTION

This invention relates to a rock bolt.

BACKGROUND OF THE INVENTION

Rock bolts are used extensively in underground mining. The type of rock bolt which is used, and the way it is used, are determined by various factors including geological conditions at an installation site.

When a relatively narrow seam of ore is mined, it is cost-effective to remove only sufficient rock to enable the seam to be accessed by workers. This aspect, at least, can give rise to relatively narrow stopes which may be no more than 900 mm in height. Conditions in this type of excavation are arduous and can be daunting. Safe mining in this kind of environment requires that the rock body must be adequately supported.

Various support techniques can be used. In one approach, e.g. in hard rock mining in South African gold mines, a relatively large diameter hole is drilled into a rock body and thereafter a rock bolt is inserted into the hole. A point anchor can be used to fix the bolt in place but, preferentially, full column grouting is used to obtain superior load characteristics. To achieve this objective, without making excessive use of steel, a tubular steel rock bolt, as opposed to a solid steel shank, is inserted into a hole and fixed in position using a grout or a resin mix. This technique provides good support and is well-established and, for this reason, is not further described herein.

In a narrow stope of, say, 900 mm, it may be a requirement, to achieve satisfactory levels of operation, for each rock bolt to extend into the rock body by, for example, 1800 mm. If the rock bolt is made from a rigid tubular member then this aspect can only be adequately addressed if a bolt is made from relatively short segments which can be handled in a narrow stope and which can be assembled, as required, during the installation process.

An object of the present invention is to provide a rock bolt which can be assembled at an underground site from relatively small tubular sections, without compromising the strength of the assembled rock bolt and which allows for effective full column grouting or resin fixing.

SUMMARY OF INVENTION

The invention provides, in the first instance, a rock bolt component which includes an elongate tubular section with an internal bore, a first end and an opposing second end, and a fixing member which comprises an elongate body which has a securing portion located inside the bore at the second end and a coupling formation which projects from the second end, and wherein the fixing member is secured to the tubular section by deforming material of the tubular section at or adjacent the second end into engagement with the securing portion.

The coupling formation may include a male or a female formation. The coupling formation may be threaded.

Depending on the intended mode of use of the rock bolt component, the thread may be a left-hand thread and may be relatively coarse with a substantial root dimension. These features enable coupling formations of complementary types to be engaged with each other with relative ease and for the coupled components to be capable of transmitting a substantial tensile load.

The securing portion of the fixing member may have any appropriate shape. In one preferred embodiment the securing portion has keying formations in the form of alternating circumferentially extending ribs and channels. This, however, is exemplary only and is non-limiting.

The invention extends, in the second instance, to a rock bolt which includes a first rock bolt component of the aforementioned kind with a coupling formation which is a male formation. The rock bolt further includes a second rock bolt component of the aforementioned kind with a coupling formation which is a female formation which is of complementary shape to, and which is engageable, with a screw action, with the male formation.

BRIEF DESCRIPTION OF THE DRAWINGS

The invention is further described by way of example with reference to the accompanying drawings in which.

DESCRIPTION OF PREFERRED EMBODIMENT

Figure 1:
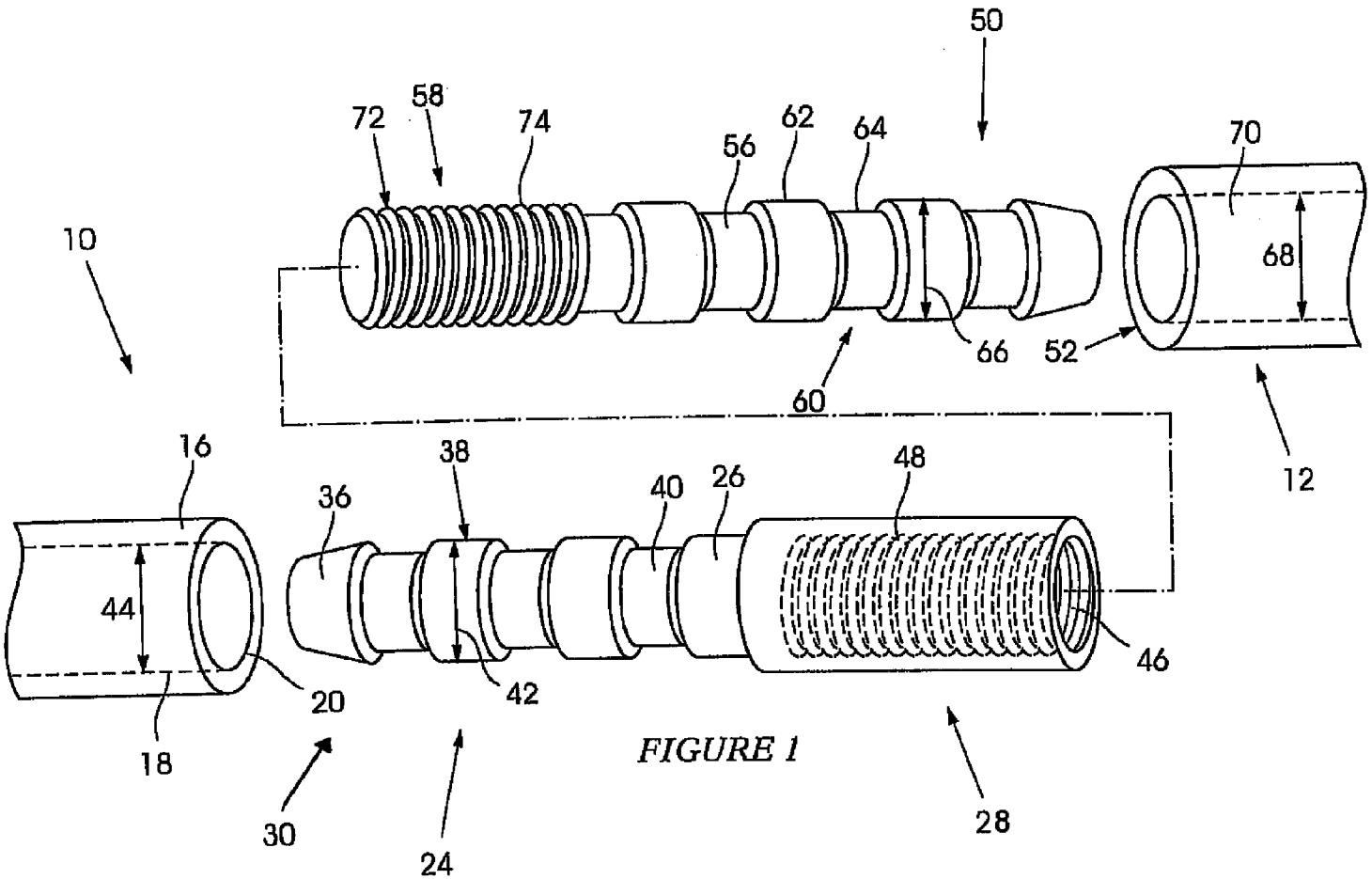
FIG. 1 shows from one side, and in cross-section, portions of a component of a rock bolt according to the invention in a disassembled state.

FIG. 1 of the accompanying drawings illustrates end portions of two rock bolt components comprising elongate tubular sections 10 and 12 respectively. The sections are substantially identical to each other and are made in any appropriate process.

The section 10 has a circular wall 16 with external formations, not shown, which assist in bonding the section in position in a borehole in a rock face, also not shown, an inner bore 18, an end 20 and an opposed end, not shown in the drawings.

As the section 12 is substantially the same as the section 10 its construction is not described herein.

A first fixing member 24 is shown displaced from the end 20. The first fixing member 24 comprises an elongate body 26 which is formed with a coupling formation 28 and a securing portion 30. The securing portion 30 is solid steel and includes a plurality of external keying formations 36. In this example, the keying formations 36 comprise alternating circumferentially extending ribs 38 and channels 40. The ribs have a maximum outer diameter 42 which is substantially the same as a diameter 44 of the bore 18.

The coupling formation 28 has a relatively deep socket 46 with internal threads 48.

A second fixing member 50 is shown displaced from an end 52 of the section 12. The second fixing member 50 comprises an elongate body 56 which is formed with a coupling formation 58 and a securing portion 60. The securing portion 60 is substantially the same as the securing portion 30, and includes circumferentially extending alternating ribs 62 and channels 64. The ribs have a maximum diameter 66 which is substantially the same as the diameter 68 of a bore 70 in the section 12.

The coupling formation 58 comprises a spigot 72 which has threads 74 which are complementary to the threads 48 in the socket 46 of the first fixing member 24.

The first fixing member 24 is inserted into the bore 18 and is then subjected to a metal working process which deforms the wall 16 into tight engagement with the keying formations 36, i.e. the ribs 38 and channels 40, which oppose a surface of the bore 18. The nature of the deformation is such that portions of the wall 16 are displaced into close fitting contact with recesses defined by the channels 40. Similarly, the second fixing member 50 is secured to the section 12 by inserting the securing portion 60 into the bore 70 of the section 12. The wall of the section 12, overlying the securing portion, is then deformed radially inwardly so that parts of the wall are forced into recesses formed by the channels 64.

The deformation processes to which the respective ends of the sections 10 and 12 are subjected ensure that each first fixing member 24 and each second fixing member 50 is fixed to the corresponding section in a way which inhibits longitudinal movement of the fixing member relative to the section. Additionally, the retentive force which is exerted by means of the deformation process is such that each fixing member is constrained against rotational movement about a longitudinal axis relative to the corresponding section. Thus, if the section is rotated, the fixing member is also rotated.

Figure 2:
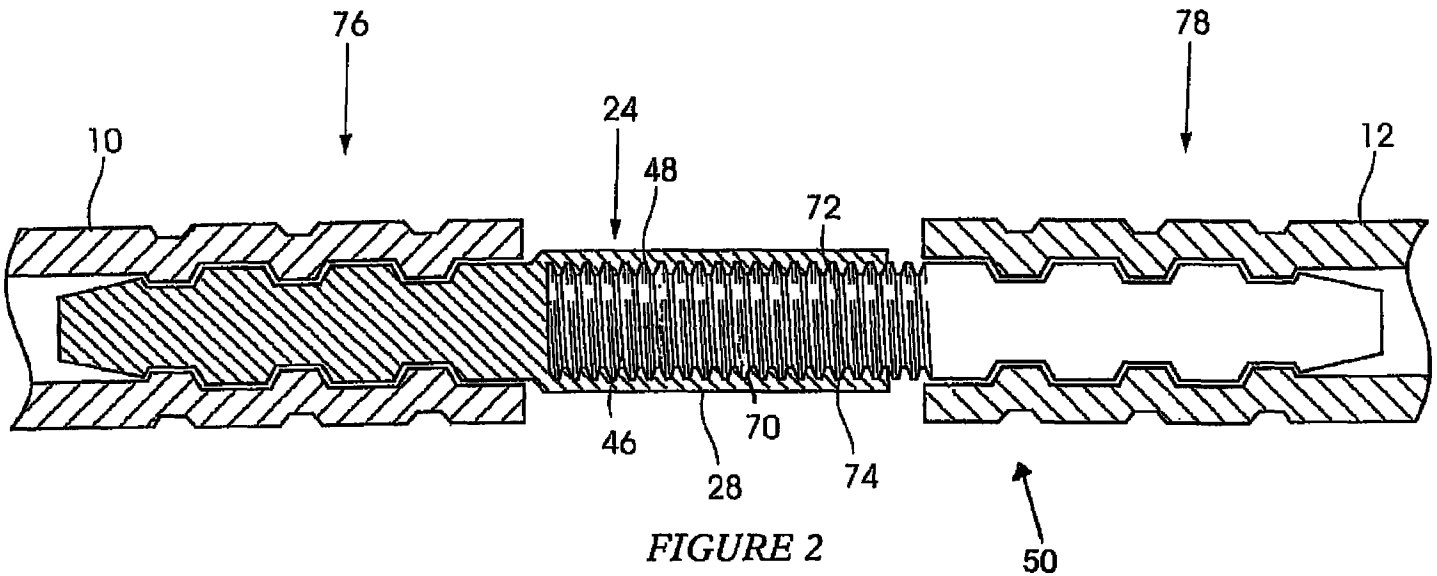
FIG. 2 shows the components of FIG. 1 interengaged with each other.

FIG. 2 illustrates from one side and in cross-section how two rock bolt components 76 and 78 respectively, comprising, on one hand, the interconnected section 10 and the first fixing member 24 and, on the other hand, the interconnected section 12 and the second fixing member 50, are coupled to each other. All that is required is for the threaded spigot 72 to be screwed into the correspondingly threaded socket 46. The threads 48 and 74 may be left-hand threads so that the assembled rock bolt can be rotated, by means of a suitable tool, in an opposing sense e.g. for mixing of a fixing resin placed in the borehole.

For an underground application e.g. for use in a narrow stope, each component is made a suitable length which can be used without restriction in the stope. A first component is advanced into a borehole in the rock body and the other component is then screwed onto a protruding end of the first component. The strength of the threaded coupling is at least equal to the tensile strength of each tubular section. Additionally, the coupling of components is done in a way which does not alter the strength of each tubular section. The capability of fixing each tubular section, and hence of the assembled rock bolt, with a resinous mixture or grout, in an optimal manner in a borehole, is thus not compromised.

What is claimed is:

1. A rock bolt component comprising:

an elongate tubular section with an internal bore, a first end and an opposing second end; and a first fixing member having a first elongate body, which first elongate body includes a first securing portion having a first plurality of external keying formations at a first end of the first fixing member, which first securing portion is positioned inside the internal bore at the first end of the elongate tubular section, and a female coupling formation at a second end of the first fixing member, and wherein the securing portion of the first fixing member is secured to the first end of the tubular section by radial inward deformation of the first end of tubular section into engagement with the first securing portion; and a second fixing member having a second elongate body including a second securing portion having a second plurality of external keying formations at a first end of the second fixing member, which second securing portion is positioned inside the internal bore at the second end of the elongate tubular section and a male threaded coupling formation at a second end of the second fixing member and wherein the securing portion of the second fixing member is secured to the second end of the tubular section by radial inward deformation of the second end of the tubular section into engage ent with the second securing portion.

2. The rock bolt component of claim 1 wherein each of said external keying formations includes circumferentially extending, axially spaced ribs and channels.

3. The rock bolt component of claim 2 wherein each of said ribs has an outer diameter the same as said internal bore of said elongate tubular section.

4. The rock bolt component of claim 2 wherein said first and second ends of said elongate tubular section are deformed into close fitting contact with recesses in said fixing members defined by said channels.

* * * * *